US005078427A

United States Patent [19]

Ishii et al.

[11] Patent Number: 5,078,427

[45] Date of Patent: * Jan. 7, 1992

[54] LABEL HAVING SUBLIMATION TRANSFERRED IMAGE

[75] Inventors: Tohru Ishii; Koichi Asahi; Masahisa Yamaguchi, all of Shinjuku, Japan

[73] Assignee: Dai Nippon Insatsu Kabushiki Kaisha, Japan

[ * ] Notice: The portion of the term of this patent subsequent to Jan. 15, 2008 has been disclaimed.

[21] Appl. No.: 615,389

[22] Filed: Nov. 19, 1990

Related U.S. Application Data

[63] Continuation of Ser. No. 309,300, Feb. 13, 1989, Pat. No. 4,984,823.

[30] Foreign Application Priority Data

Feb. 18, 1988 [JP] Japan ..... 63-36184

[51] Int. Cl.[5] ..... B42D 15/00

[52] U.S. Cl. ..... 283/81; 40/299; 428/42; 428/199; 283/100; 283/101

[58] Field of Search ..... 40/299, 615; 283/81, 283/100, 101; 428/42, 199; 430/201, 259

[56] References Cited

U.S. PATENT DOCUMENTS

| | | | |
|---|---|---|---|
| 1,893,225 | 1/1933 | Casswell | 283/110 |
| 2,462,735 | 2/1949 | Goldwater | 283/100 |
| 3,854,229 | 12/1974 | Morgan | 283/81 |
| 3,967,022 | 6/1976 | Hasei | 40/299 |
| 3,993,814 | 11/1976 | Cavender | 283/81 |
| 4,526,405 | 7/1985 | Hattemer | 283/81 |
| 4,536,434 | 8/1985 | Magnotta | 428/201 |
| 4,645,705 | 2/1987 | Abbott | 428/195 |
| 4,650,704 | 3/1987 | Rothenberg | 428/40 |
| 4,657,803 | 4/1987 | Pernicano | 428/201 |
| 4,711,874 | 12/1987 | Yuyama et al. | 428/204 |

*Primary Examiner*—Paul A. Bell

*Attorney, Agent, or Firm*—Parkhurst, Wendel & Rossi

[57] ABSTRACT

A label having a sublimation transferred image constituted of an image-receiving sheet, comprising a tacky layer, a sheet substrate and an image-receiving layer laminated in this order on a peeling sheet. The tacky layer, sheet substrate and image-receiving layer form a label portion, and the image-receiving sheet has a structure peelable between the label portion and the peeling sheet. The label has one or more frames of sublimation transferred images formed by transfer of a sublimable dye in a colorant layer of a heat transfer sheet by heating according to an image information. The label portion is applied with half-cut treatment with cutting lines for sectionalizing every frame of the sublimation transferred image.

8 Claims, 1 Drawing Sheet

LABEL HAVING SUBLIMATION TRANSFERRED IMAGE

This is a continuation of U.S. Ser. No. 07/309,300, filed Feb. 13, 1989, now U.S. Pat. No. 4,984,823.

BACKGROUND OF THE INVENTION

Recently there is an increasing trend that possessors of articles such as name cards, stationary, small articles, cards, etc. themselves apply unique displays, etc. as owners to such articles, thereby adding individuality, design characteristic by the possessor in addition to the commercial value of the article itself.

As an example of the above trend, there is the case where the face picture of the possessor himself, etc. is plastered or printing is applied on, for example, a part of a name card, thereby adding an appeal element by the face picture, etc. other than the letters of the name with a desire to enhance the impression degree of himself to one to which the name card is handed.

The present invention has been accomplished in view of such technical demand as mentioned above, and its object is to provide a label attached with a sublimation transferred image which can be plastered simply and rapidly onto various articles by effecting image attachment according to the heat transfer recording system which can record an image such as a photograph directly from an image on a CRT display, as different from the photographic system or the printing system.

SUMMARY OF THE INVENTION

The label having a sublimation transferred image of the present invention is constituted of an image-receiving sheet comprising a tacky layer, a sheet substrate and an image-receiving layer laminated in this order on a peeling sheet. The tacky layer, sheet substrate and image-receiving layer form a label portion, and the image-receiving sheet has a structure peelable between the label portion and the peeling sheet. The label has one or more frames of sublimation transferred images formed by transfer of a sublimable dye in a colorant layer of a heat transfer sheet by heating according to an image information. The label portion is applied with a half-cut treatment with cutting lines for sectionalizing every frame of the sublimation transferred image.

DETAILED DESCRIPTION OF THE INVENTION

Figure 1:
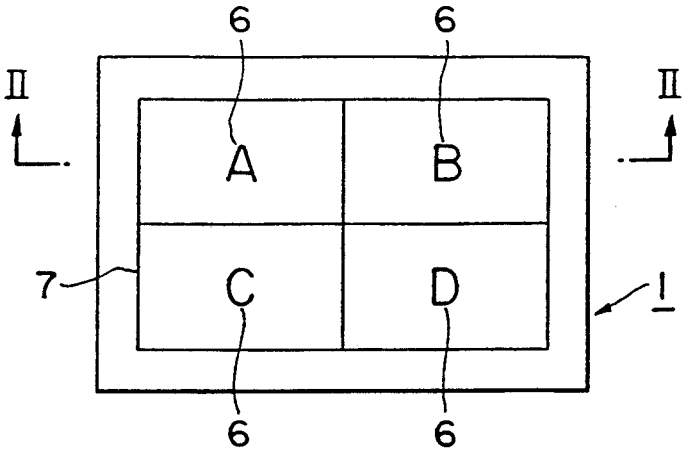
FIG. 1 is a plan view showing an example of the label having sublimation transferred image of the present invention.

Referring now to the drawings, the present invention is described in detail.

Figure 2:
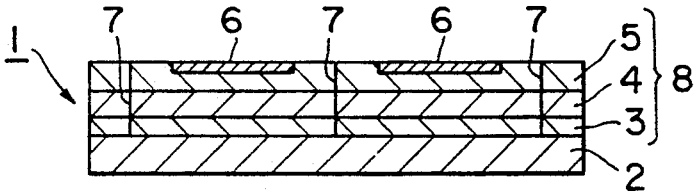
FIG. 2 is a longitudinal sectional view cut along the line II—II in FIG. 1.

FIG. 1 is a plan view showing an example of the present invention, and FIG. 2 is a longitudinal sectional view cut along the line II—II in FIG. 1. The label having sublimation transferred image 1 of the present invention comprises a laminated structure having a tacky layer 3, a sheet substrate 4 and an image-receiving layer 5 successively laminated on a peeling sheet 2 as shown in FIG. 2, and the laminated sheet itself has the function of an image-receiving sheet to be used in conventional heat transfer recording system. In the Figure, 6 shows the sublimation transferred image and 7 shows the cutting lines formed by the half-cut treatment.

Figure 4:
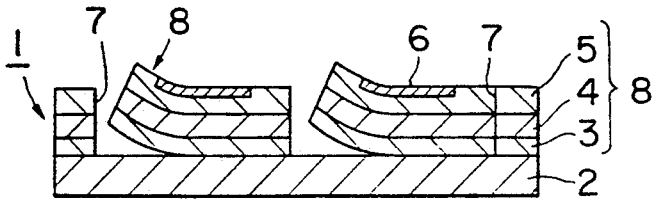
FIG. 4 is a longitudinal sectional view showing the state in which the label portion in the label of the present invention is peeled off along the cutting lines.

Also, the label 1 of the present invention has a label portion 8 formed of the tacky layer 3, the sheet substrate 4 and the image-receiving layer 5, has a peelable structure between the label portion 8 and the peeling sheet 2, and the label portion 8 can be easily eliminated by peeling off from the peeling sheet along the cutting lines 7 as shown in FIG. 4.

The above label portion 8 is the portion to be plastered onto various articles after eliminated from the peeling sheet 2, and is constituted by providing the image-receiving layer 5 on the sheet substrate 4, and providing the tacky layer 3 which enables plastering onto the surface of a desired article on the back surface of said substrate 4.

The sheet material 4 may be either transparent, translucent or opaque, and as its material, a resin film comprising polyethylene terephthalate film, rigid vinyl chloride, acrylic, vinylidene chloride, polyolefin resin, etc., or otherwise synthetic paper, natural paper, etc. may be employed. However, for obtaining high printing density, a synthetic paper or white polyethylene terephthalate film with a density of 1.2 g/cm$^3$ or less may be preferably employed, particularly a foamed polyethylene terephthalate film. The substrate 4 may be also employed as a light-shielding film with a white pigment such as titanium, calcium carbonate or zinc oxide kneaded therein. Said substrate 4 may have a thickness of 10 to 200 μm.

The image-receiving layer 5 can receive the sublimable dye migrated by heating from the colorant layer of the heat transfer sheet during heat transfer recording, thereby forming a sublimation transferred image 6 on the layer. As its material, any of the materials used for formation of image-receiving layer of the image-receiving sheets known in the art, including, for example, saturated polyester resins, polyacrylate resins, vinyl chloride-vinyl acetate copolymers, polystyrene resins or polyamide resins, which may be used either singly or as a mixture. Among them, a mixture of a polyester resin and a vinyl chloride-vinyl acetate copolymer is preferred, with the mixing ratio of the polyester resin and the vinyl chloride-vinyl acetate copolymer being preferably 50 to 200 parts by weight per 100 parts by weight of the polyester resin. By use of a mixture of a polyester resin and a vinyl chloride-vinyl acetate copolymer, light resistance of the image formed by transfer on the image-receiving layer can be improved.

On the surface of the image-receiving layer 5, a release agent layer for imparting good peelability with the heat transfer sheet can be provided, if desired. The release agent layer, when the release agent is well compatible with the material for formation of the above image-receiving layer, can be formed by incorporating a release agent in said material, while in the case of one having poor compatibility, it can be formed by coating thinly the release agent on the surface of the image-receiving layer. As the release agent, a silicone oil (e.g. combined use of an epoxy-modified silicon and an amino-modified silicone), a fluorine type or phosphate type surfactant, etc. may be used.

The material of the tacky layer 3 may include polyacrylates, acrylic copolymers, natural rubber, synthetic rubbers, petroleum resin, block copolymers such as SIS, SBR, etc. If necessary, tackiness reinforcing agent, plasticizers, fillers, etc. can be also added to the above tackifier.

On the other hand, as the peeling sheet 2 provided at the lower part of the label portion 8, synthetic paper, cellulose fiber paper, synthetic resin sheet having fine uneven surface, etc. may be employed. As the synthetic paper, those of the type having a filler filled in a polyolefin resin, which is then extruded and stretched, and of the type having a mixture comprising a filler and a binder coated on the sheet of a polyester, etc. may be employed. As the cellulose fiber paper, wood free paper, coated paper, art paper, cast coated paper, converted paper impregnated or coated or internally added with a synthetic resin or a rubber, etc. can be employed. As the synthetic resin having fine uneven surface, a sheet extruded with a filler such as clay, calcium carbonate, titanium oxide, etc. contained therein, or a laminated sheet formed by performing said extrusion on a wood free paper, etc., or a sheet having fine unevenness formed on the surface by the sand blast method or the embossing method, etc. may be employed. As the sheet 2, a foamed synthetic resin can be also used. As the sheet 2, particularly a white polyethylene terephthalate film with a density of 1.2 $g/cm^3$ or less applied with the release treatment is preferred, because high printing density can be obtained and also it is relatively less expensive to be advantageous in cost. As the above release treatment, there may be employed the method in which a silicone oil of the dimethylpolysiloxane type is coated to a solid component of 0.2 to 0.8 $g/m^2$ on drying and subjected to the heat treatment at a temperature of about 120° to 180° C. after drying, etc.

On the peeling sheet 2, if desired, a release layer for making peeling between the sheet 2 and the label portion 8 (specifically between the tacky layer 3 and the peeling sheet) easier can be provided. The release layer may be formed by use of a silicone type release agent composed mainly of polymethylsiloxane, etc. or a polyolefin, etc.

The sublimation transferred image 6 in the label 1 of the present invention is an image formed by applying conventional heat transfer recording system to the image-receiving sheet having the constitution as described above, and therefore formed by combination with a heat transfer sheet by transfer of the sublimable dye in the colorant layer of the heat transfer sheet onto the image-receiving layer 5 by heating with a thermal head, etc. of which heating is suppressed by the electrical signals corresponding to the image information.

The image content in the above image 6 is not particularly limited, but can be constituted of any desired content and may be a letter, a symbol, a figure, etc.

The image 6 may have any desired number of "frames" which is the unit of the image content, either a single number or a plural number. In this example, as shown in FIG. 1, there is shown an example of image constituted of 4 frames of A, B, C, D. (In FIG. 1, the above alphabet symbol itself may be also understood as the image 6.)

When the image 6 is constituted of a plural number of frames, the image contents in the respective frames may be constituted all of the same content, or contents different from each other.

The image in the label of the present invention is a sublimation transferred image obtained by heat transfer recording, and therefore it is a sharp image like photographic tone, and since the image content can be simply edited by electrical manipulation on a CRT display, also an image with a content enriched in variety can be easily obtained.

The label 1 of the present invention is applied with the half-cut treatment at the label portion 8 as shown in FIG. 2, and every one frame of the image 6 is sectionalized with the cutting lines 7 by the treatment and, for example, distinct sectionalization is effected for every frame image of A, B, C, D as in this example shown in FIG. 1. The above half-cut treatment is to enable accurate and orderly elimination of the label portion 8 having the image 6 of one frame surrounded by the cutting lines 7 from the peeling sheet 2. Also, this treatment is effective for making a clue to initiation of the label, since the label portion end begins to be peeled off naturally by bending more or less the label 1 itself in peeling off the label portion 8. Thus, the "half-cut treatment" in the present invention refers to applying cutting lines to the desired sections so that only the label portion can be peeled off with the peeling sheet being left to remain.

The half-cut treatment in this example is applied so that the boundary portions (lines) of the respective images 6 comprising frames of A, B, C, D being bonded to each other, but is not limited to the treatment with such constitution, but, for example, may be also applied to the state such that the boundary portions of the respective images 6 comprising the frames of A, B, C, D are apart from each other (in other words, the state in which each image is completely partitioned with its cutting lines).

The cutting lines 7 can set the kind of the lines, the shape drawn by the lined, etc. depending on the image content of the image 6. For example, the shape drawn by the lines is not limited to the rectangular shape comprising straight lines as shown in FIG. 1, but may be such shape as circular, triangular, etc.

Figure 3:
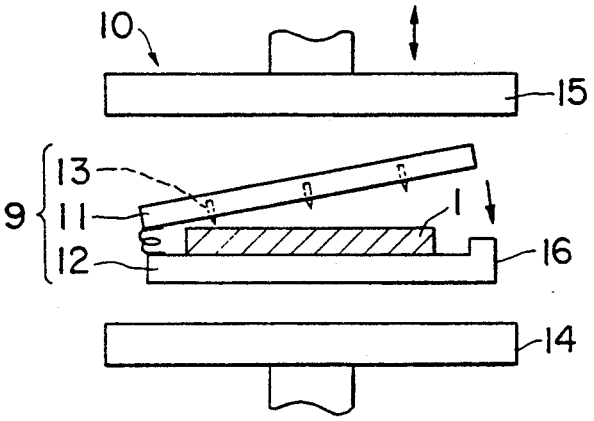
FIG. 3 is an illustration of an example of the punching machine for applying the half-cut treatment.

In applying the half-cut treatment as described above, it can be practiced by use of a punching machine, for example, can be applied by a punching machine as shown in FIG. 3. More specifically, the punching machine shown in the same Figure is constructed of a half-punching machine 9 and a pressing machine 10, the half-punching machine 9 having an upper plate 11 and a lower plate 12 which are freely openable with one ends thereof being mutually engaged with each other, said upper plate 11 having cutting blades 13 arranged so as to come along the cutting lines to be provided on the label provided thereon, while the pressing machine 10 comprises a fixing stand 14 and a vertically movable plate 15. Accordingly, by use of this punching machine, the label 1 of the present invention is mounted on the lower plate 12 of the half-punching machine 9, the upper plate 11 is descended to sandwich the label 1 between the upper and lower plates (during this operation, registration whether the cutting blades 13 are positioned at predetermined sites is sufficiently done), and then the half-punching machine 9 is set within the pressing machine 10 and the pressing plate 15 is descended to pressurize the half-punching machine as a whole, whereby the cutting blades 13 are progressed to a desired depth of the label 1 and the cutting lines are provided by impression at the desired sites to effect the half-cut treatment. In the Figure, 16 is a control stopper for stopping the descending upper plate 11 at the predetermined position for permitting the blade 13 to be progressed to a desired depth in the label 1, namely corresponding to the thickness of the label portion 8.

In the present invention, the label can be provided with a detection mark. A detection mark is very convenient in carrying out correct registration with the heat transfer sheet during image formation, and can be provided by, for example, printing a detection mark detectable by a photoelectric tube detecting device on the back surface of the peeling sheet 2.

Also, in the present invention, an intermediate layer having cushioning property, thermally insulating property can be provided between the sheet substrate 4 and the image-receiving layer 5 and when such intermediate layer is provided, the noise is little and an image corresponding to the image information can be transfer recorded with good reproducibility. As the material constituting the intermediate layer, for example, urethane resin, acrylic resin, ethylenic resin, butadiene rubber or epoxy resin may be employed. The intermediate layer may have a thickness preferably of 2 to 20 μm.

Further, in the present invention, an antistatic agent can be contained on the back surface of the peeling sheet 2. By incorporating an antistatic agent, slippage between the labels can be made more smooth, and also there is the effect of preventing attachment of dust, etc. onto the label during transfer recording. The antistatic agent may be contained in the peeling sheet 2 or the image-receiving layer 6, or alternatively an antistatic agent layer can be provided on the back surface of the peeling sheet 2, etc.

The label of the present invention can be also provided on the back surface of the peeling sheet 2 with a lubricating layer. The label during transfer recording performs transfer by delivering the piled labels one by one and, in this case, provision of a lubricating layer makes slippage mutually between the sheets smooth, whereby the sheets can be taken out one by one accurately along with the antistatic treatment as described above. As the lubricating layer, a methacrylate resin such as of methyl methacrylate or a corresponding acrylate resin, a vinyl resin such as vinyl chloride-vinyl acetate copolymer may be employed.

The label 1 of the present invention generally applies the half-cut treatment after formation of the image 6, but formation of image may be also done so as to be confined within the frame range formed by the cutting lines after previous application of the half-cut treatment.

Figure 5:
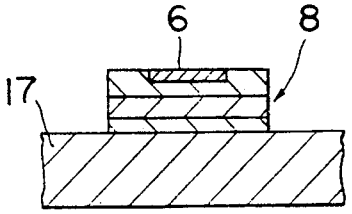
FIG. 5 is a longitudinal sectional view showing the state in which the label of the present invention is plastered onto a member to be plastered.

In using practically the label 1 of the present invention comprising the constitution as described above, the label portion 8 is peeled off from the peeling sheet 2 along the cutting lines 7 by the half-cut treatment as shown in FIG. 4, and then the label portion 8 comprising a predetermined shape sectionalized with the cutting lines having the sublimation transferred image 6 as shown in FIG. 5 is plastered onto a desired member to be plastered 17.

The member to be plastered 17 may be any article, provided that plastering thereon is possible, including, for example, name card, bankbook, cards, school things (plastic board, pencil case, etc.), and otherwise may be an article such as umbrella, etc.

By plastering the label of the present invention onto such article to be plastered, a desired display with the sublimation transferred image of the label can be effected, whereby the display intended by the possessor can be added.

The present invention is described below in more detail by referring to Examples.

EXAMPLE 1

On a white polyethylene terephthalate film with a thickness of 50 μm was applied an ink composition for formation of an image-receiving layer composed mainly of a polyester resin, of which the back surface was coated with a rubber type tackifier to form a tacky layer, and then a foamed polyethylene terephthalate film with a thickness of 100 μm as the release sheet was laminated on the tacky layer side to obtain an image-receiving sheet.

Next, after a detection mark was printed on the release sheet surface, a transfer image constituting one image surface with 25 frames was formed according to the well-known heat transfer recording method, and then half-cut treatment was applied so as to sectionalize every one of the above frames by use of a punching machine as shown in FIG. 3 to obtain a label of the present invention.

The above image comprises frames with one frame having a size of 17 mm × 16 mm, and 5 frames with one frame of image having such size are arranged in longitudinal and lateral directions, respectively.

When the label portion of one frame comprising an image content of a face and a corporation mark of the label obtained was plastered on a name card, in carrying out such plastering, said label portion could be easily peeled off with a clear-cut outline orderly along the cutting line by the half-cut treatment, and also a name card having an image display portion with sharp face and corporation mark could be obtained.

EXAMPLE 2

After an image-receiving layer, a tacky layer and a peeling sheet were formed by lamination on a transparent polyethylene terephthalate sheet with a thickness of 50 μm in the same manner as in Example 1, on the peeling sheet surface was further adhered a foamed polyethylene terephthalate film with a thickness of 100 μm as the peeling sheet to obtain an image-receiving sheet, and the same transfer image formation and half-cut treatment were performed in the same manner as in Example 1 by use thereof to obtain a label of the present invention.

Since this label had a foamed resin sheet provided as the peeling sheet, the transfer image obtained was found to be a very sharp image.

EXAMPLE 3

On the surface of a foamed polyethylene terephthalate film with a thickness of 50 μm and a density of 1.0 g/cm$^2$ was applied an ink composition for formation of image-receiving layer having the following composition to a thickness on drying of about 5 μm, and on the back surface was applied an acrylic tackifier to a thickness on drying of about 10 μm to form a tackifier layer, followed by lamination on the tackifier layer side of a release sheet comprising a foamed polyethylene terephthalate sheet with a thickness of 100 μm applied with a release treatment, to obtain an image-receiving sheet.

| Ink composition for formation of image-receiving layer | |
|---|---|
| Vylon 600 (polyester resin: manufactured by Toyobo, Japan) | 10 wt. parts |
| VAGH (vinyl chloride-vinyl acetate copolymer resin: manufactured by Union Carbide) | 4 wt. parts |
| #1000A (vinyl chloride-vinyl acetate copolymer resin: manufactured by Denki Kagaku Kogyo, Japan) | 6 wt. parts |
| Methyl ethyl ketone | 40 wt. parts |
| Toluene | 40 wt. parts |
| X22 3000E (epoxy-modified silicone: manufactured by Shinetsu Kagaku Kogyo, Japan) | 0.5 wt. parts |
| X22 3050C (amino-modified silicone: manufactured by Shinetsu Kagaku Kogyo, Japan) | 0.5 wt. parts |

When the same as in Example 1 was formed on the image-receiving sheet by means of a heat transfer recording device at a printing energy of 100 mJ/mm$^2$, the image obtained had a color formed density of 0.9.

EXAMPLE 4

An image-receiving member was obtained in the same manner as in Example 3 except for using a synthetic paper with a thickness of 110 μm (Yupo FPG 110: manufactured by Oji Seishi K.K., Japan) in place of the foamed polyethylene terephthalate film as the sheet substrate, and an image was formed by heat transfer on the image-receiving sheet under the same conditions as in Example 3. The image had a color formed density of 1.0.

EXAMPLE 5

An image-receiving sheet was obtained in the same manner as in Example 3 except for using a white polyethylene terephthalate film (density 1.4 g/cm$^3$) with a thickness of 50 μm containing titanium oxide kneaded therein as the sheet substrate, and an image was formed by heat transfer on the image-receiving member under the same conditions as in Example 3. The image had a density of 0.85.

EXAMPLE 6

An image-receiving sheet was obtained in the same manner as in Example 4 except that the polyester resin component (Vylon 600) in the ink composition for formation of image-receiving layer was replaced with a mixture of the polyester resin (Vylon 600) and a vinyl chloride-vinyl acetate copolymer (manufactured by Denki Kagaku Kogyo, Japan): #1000A) (a mixture of 4 parts by weight of the polyester resin and 6 parts by weight of the vinyl chloride-vinyl acetate copolymer), and an image was formed by heat transfer on the image-receiving sheet under the same conditions as in Example 3. The image obtained had a color formed density of 0.9. When the mixture of the polyester resin and the vinyl chloride-vinyl acetate copolymer was used as the resin component in the ink composition for formation of image-receiving layer, as contrasted to the case when only the polyester resin was employed wherein light resistance was 10% of fading ratio by 3 grade irradiation in the cyan printed product, the fading ratio under the same conditions was 5% to be improved in light resistance of the image as compared with the case of the polyester resin alone.

EXAMPLE 7

On the image-receiving sheet obtained in the same manner as in Example 3 except for changing the release sheet to a laminate of a foamed polyethylene terephthalate film (thickness 100 μm, density 1.0 g/cm$^3$) and a release polyethylene terephthalate film (thickness 25 μm, density 1.4 g/cm$^3$), an image was formed by heat transfer under the same conditions as in Example 3. The image obtained had a color formed density of 0.8.

As described above, the label of the present invention which is attached with a sublimation transfer image, has a very distinct image, and can easily give an image formed by combining freely different kinds of image contents such as letters and face images of men, etc. Further, since the label portion is applied with half-cut treatment, during peel-off, a desired one frame of label portion can be peeled off easily and orderly along the cutting lines.

Thus, the label of the present invention can be simply plastered onto various articles by peeling off the desired portion easily, and also by plastering of the label portion, the image contents constituted freely can function as the new display portion of articles, whereby the added value of the articles can be easily improved.

What is claimed is:

1. An image receiving sheet, comprising:

a peeling sheet;

an antistatic layer provided on said peeling sheet;

a label portion adhered to said peeling sheet, said label portion comprising a tacky layer laminated on said peeling sheet, a sheet substrate laminated on said tacky layer, and an image-receiving layer laminated on said sheet substrate, said label portion having at least one frame of a sublimation transferred image formed in said image receiving layer by transferring a sublimable dye from a colorant layer of a heat transfer sheet to said image-receiving layer by heating according to an image formation; and cutting lines formed through said label portion to section said at least one frame of a sublimation transferred image, so as to allow individual peeling of sectioned frames of said label portion from said peeling sheet.

2. The image receiving sheet of claim 1, further comprising an intermediate layer having a cushioning and/or thermally insulating property provided between said sheet substrate and said image-receiving layer.

3. The image receiving sheet of claim 1, further comprising a detection mark.

4. The image receiving sheet of claim 1, further comprising a release layer provided between said peeling sheet and said tacky layer.

5. An image receiving sheet, comprising:

a peeling sheet;

an antistatic layer provided on said peeling sheet; and a label portion adhered to said peeling sheet, said label portion being sectioned, via cutting lines formed therethrough, into an inner region and an outer frame continuously surrounding said inner region, said inner region being divided into a plurality of sections, via cutting lines formed through said label portion, so as to allow individual peeling of said sections from said peeling sheet;

each of said sections comprising (i) a tacky layer laminated on said peeling sheet, (ii) a sheet substrate laminated on said tacky layer, and (iii) an image-receiving layer laminated on said sheet substrate, said image-receiving layer having a sublimation transferred image formed by transferring a sublimable dye from a colorant layer of a heat transfer sheet to said image-receiving layer by heating according to an image formation.

6. The image receiving sheet of claim 5, further comprising an intermediate layer having a cushioning and/or thermally insulating property provided between said sheet substrate and said image-receiving layer.

7. The image receiving sheet of claim 5, further comprising a detection mark.

8. The image receiving sheet of claim 5, further comprising a release layer provided between said peeling sheet and said tacky layer.

* * * * *